US005820332A

United States Patent [19]

Philips et al.

[11] Patent Number: 5,820,332

[45] Date of Patent: Oct. 13, 1998

[54] HEAVY DUTY COUPLER FOR ATTACHING AN IMPLEMENT TO WORK VEHICLE

[75] Inventors: Mark S. Philips, Wichita; Stephen A. Youngers, Clearwater; Robert G. Draney; Kenneth W. Johnston, both of Wichita, all of Kans.; Mike E. Delaney; Charles B. Hanson, both of Burlington, Iowa; James A. Werbin, Derby, Kans.

[73] Assignee: Case Corporation, Racine, Wis.

[21] Appl. No.: 850,182

[22] Filed: May 2, 1997

[51] Int. Cl.[6] ..... E02F 3/81

[52] U.S. Cl. ..... 414/723; 414/724

[58] Field of Search ..... 414/685, 723, 414/724; 37/903; 172/251

[56] References Cited

U.S. PATENT DOCUMENTS

| | | | |
|---|---|---|---|
| 3,269,570 | 8/1966 | Wallberg . | |
| 3,672,521 | 6/1972 | Bauer et al. . | |
| 4,176,727 | 12/1979 | Perin . | |
| 4,187,050 | 2/1980 | Barbee | 414/723 |
| 4,436,477 | 3/1984 | Lenertz et al. | 414/723 |
| 4,452,560 | 6/1984 | Coyle et al. | 414/723 |
| 4,480,955 | 11/1984 | Andrews et al. | 414/723 |
| 4,509,768 | 4/1985 | Haug | 414/723 |
| 4,545,720 | 10/1985 | Cochran et al. | 414/723 |
| 4,824,319 | 4/1989 | Arnold | 414/723 |
| 4,850,790 | 7/1989 | Johnson et al. | 414/723 |
| 5,098,252 | 3/1992 | Sheesley et al. | 414/723 |
| 5,263,810 | 11/1993 | Takeata et al. | 414/723 |
| 5,403,144 | 4/1995 | Staben, Jr. | 414/697 |
| 5,415,235 | 5/1995 | Gebauer | 414/723 |

*Primary Examiner*—Karen M. Young
*Assistant Examiner*—Gregory A. Morse
*Attorney, Agent, or Firm*—Foley & Lardner

[57] ABSTRACT

A coupling assembly for releasably securing an implement to a work vehicle. The coupling system includes top wedges which are engaged in wedge-shaped sockets, and tapered lower hooks that apply a continuous force to a pin or cylindrical rod which operates to tightly engage the wedges in the wedge-shaped sockets, thereby preventing movement and resultant wear between the engaging portions of the coupling assembly and having the capability of handling heavy, high load inducing attachments as well as existing attachments.

18 Claims, 4 Drawing Sheets

HEAVY DUTY COUPLER FOR ATTACHING AN IMPLEMENT TO WORK VEHICLE

FIELD OF THE INVENTION

The present invention relates to a coupler for quickly attaching and releasing an implement to an implement operating mechanism on a work vehicle such as a front-end loader. More particularly, it relates to a coupler which is intended to handle heavy, high load inducing attachments as well as existing attachments.

BACKGROUND OF THE INVENTION

Typically, work vehicles such as end loaders are provided with a loader-arm or a 3-point hitch to which various types of work implements are releasably attached. A coupling assembly is provided, with a portion on the work vehicle and another portion on the work implement, such that work implements may be readily coupled to and removed from the work vehicle. As heavier, and higher load inducing attachments or work implements are provided, it has been found desirable to provide a more robust coupling assembly. High load inducing and heavy attachments require the coupler to maintain a tight fit, have the mechanical strength to carry the load, and maintain all the advantages of a quick type coupler.

Currently used coupling arrangements typically have a slot or hole in one portion of the coupling which receives a sliding wedge pin provided on the other part of the coupling. It has been found that in some such couplings, movement of the pin in the slot will cause wear of the pin, or of the side walls of the slot engaged by the pin, or both. As material of the pin, or of the side walls of the slot, or of both, is worn away, greater movement of the pin in the slot will occur, which will result in even greater wear, and in the extreme case, will result in an undesirable decoupling of the work implement from the work vehicle.

Further, in traditional couplers, binding has occurred in the latching mechanism linkage provided for moving the pin, and also at the coupler/attachment interface. The accumulation of mud, corrosion, and other material on the latching mechanism has on occasion caused the latching mechanism to "freeze up".

It is therefore desirable to provide a coupling assembly which will not only handle high load inducing and heavy attachments, but which also maintains a tight coupling, and avoids binding of the latching mechanism. It is also desirable that the coupling assembly be useable with the portion of a coupling mechanism provided on traditional attachments.

SUMMARY OF THE INVENTION

The present invention provides a coupling assembly which is adapted to handle heavy, high load inducing attachments as well as existing attachments currently in service. The coupling assembly of the present invention achieves this goal, in part, by utilizing a hook and captured pin action, in lieu of a sliding wedge pin at the bottom of the coupler and attachment as used in prior coupling systems. The coupling arrangement of the present invention includes a V-shaped slot at the top of the implement portion of the coupling which receives a tapered wedge-like member carried by the work vehicle portion of the coupling. A rod carried by the implement portion of the coupling is engaged by a rotating hook-like member carried by the work vehicle portion of the coupling. The hook opening is tapered, creating a tightening and wedging action at the interface with the pin when the hook is rotated. With respect to existing attachments, as the hook-like member at the lower portion of the coupler is rotated, it acts as the latch pin, fitting into the slot on the attachment. This provides the same fit as the latch pin does for existing attachments. Further, depending upon the size and shape of the slot, the hook-like member may provide a tightening and wedging action.

DETAILED DESCRIPTION OF THE PREFERRED EMBODIMENT

Figure 1:
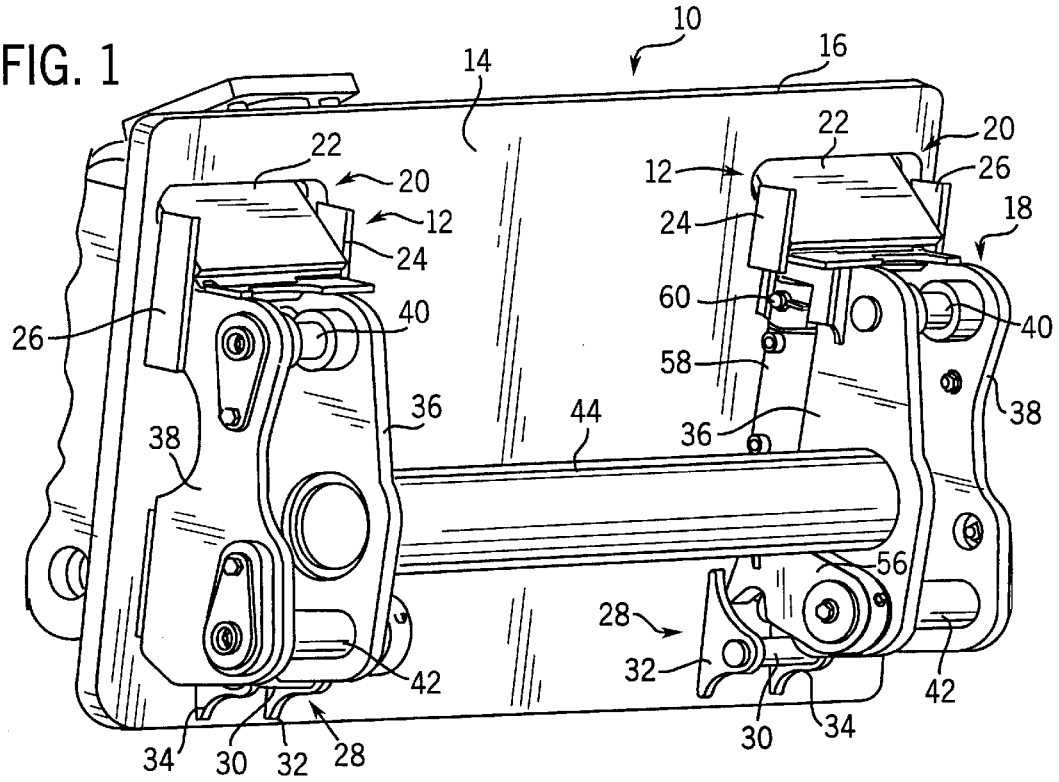
FIG. 1 is a perspective view of a coupling assembly in accordance with this invention for attaching an operating tool to the implement carrying portion of a work vehicle, with the coupling assembly partially engaged.
Figure 2:
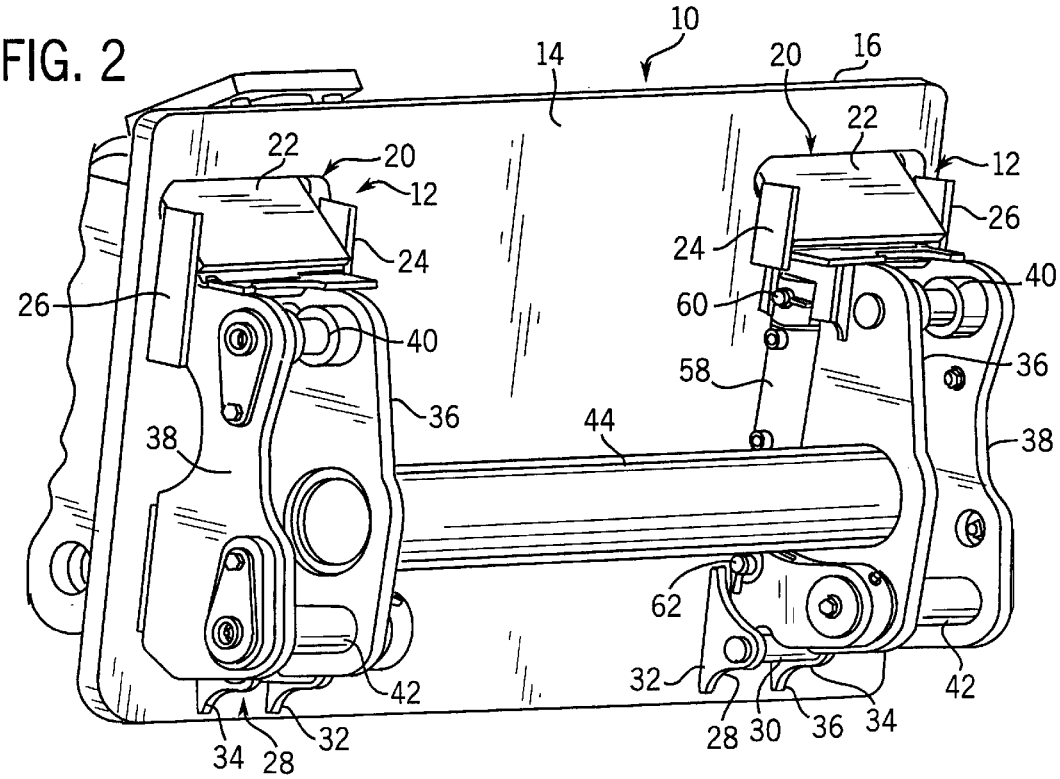
FIG. 2 is a perspective view of the coupling assembly shown in FIG. 1, with the coupling assembly fully engaged.

Referring to FIGS. 1 and 2, a coupling assembly 10 in accordance with the present invention is shown. The coupling assembly 10 includes a first female portion 12 which is formed on a rear face 14 of an implement supporting member 16. A second male portion 18 is secured to the implement carrying portion of a work vehicle, such as an end loader.

Figure 7:
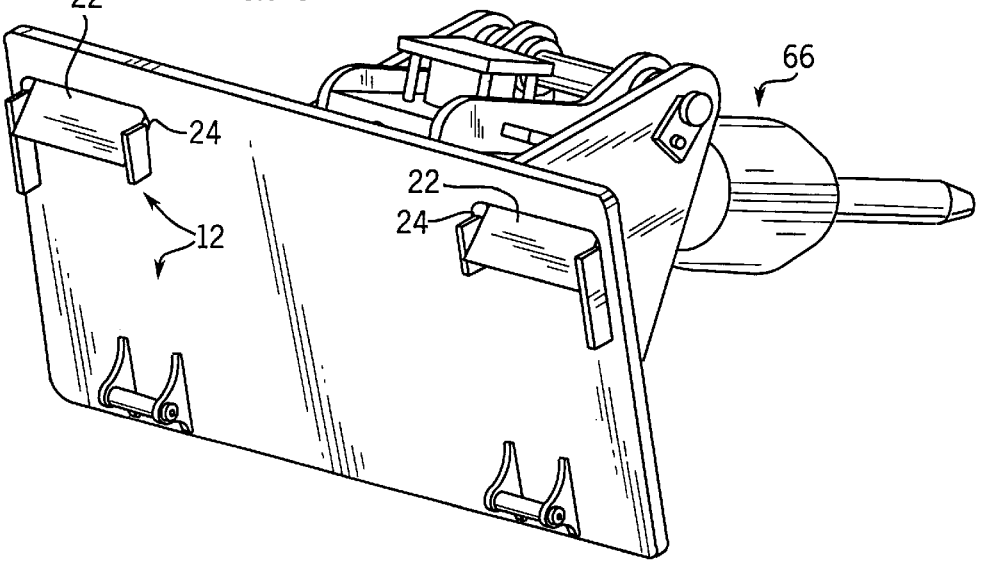
FIG. 7 is a perspective view of the portion of the coupling assembly shown in FIG. 1, which is carried by the implement, as viewed from the vehicle side.

The female portion 12 of the coupling assembly 10, as shown in FIGS. 1, 2 and 7, includes a pair of wedge-shaped sockets 20 located near the top of the rear face 14 of the implement supporting member 16. The pair of wedge-shaped sockets 20 are each formed with an outwardly and downwardly sloping member 22, and a pair of outwardly projecting vertical side members 24 and 26 on opposite sides of the sloping member 22. Each female portion 12 also includes a pair of bracket assemblies 28 located directly below the pair of the wedge-shaped sockets 20. Each of the bracket assemblies 28 is formed by a cylindrical rod 30 held at each end in a spaced relationship from the rear face 14 by a pair of vertical support members 32 and 34.

The male portion 18 of the coupling assembly, as shown in FIGS. 1–4, is formed with two pairs of spaced plates 36 and 38, which are secured to each other by a vertically spaced pair of pins 40 and 42. The vertically spaced parallel pins 40 and 42 are engaged by securing means provided on the implement carrying portion of the work vehicle to secure the male portion 18 of the coupling assembly to the work vehicle. While the use of the parallel spaced pins 40 and 42 is a preferred arrangement for securing the male portion of the coupling assembly 18 to the implement carrying portion of the work vehicle, other arrangements could be used with the coupling assembly of this invention as well.

Figure 3:
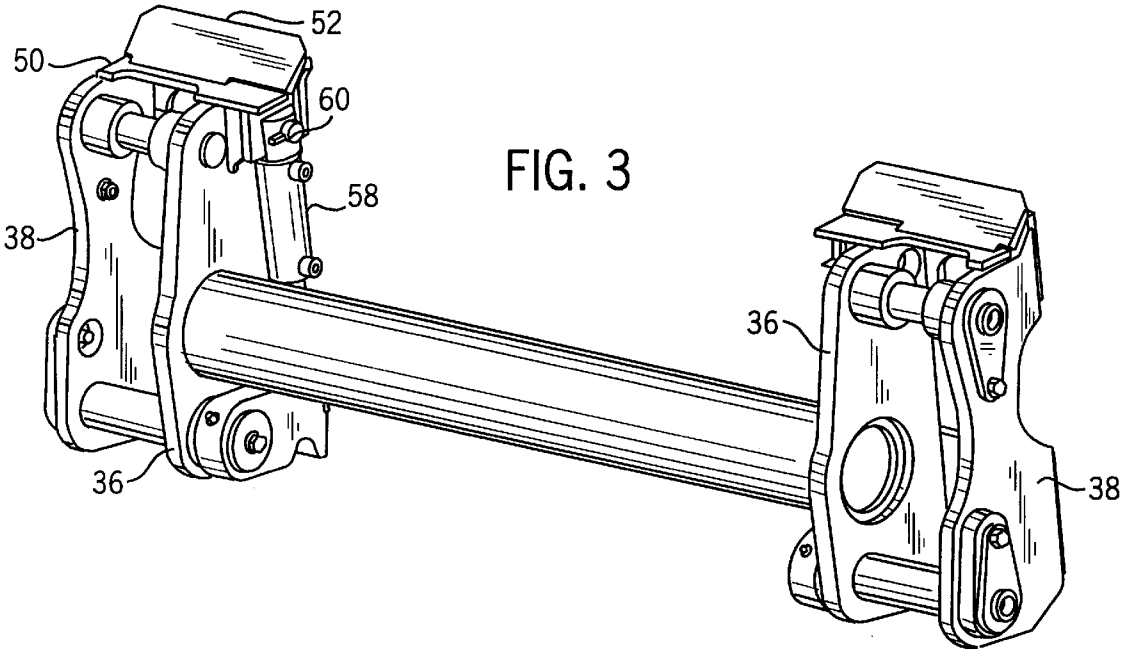
FIG. 3 is a perspective view of the portion of the coupling assembly shown in FIG. 1, which is carried by the implement carrying mechanism of the vehicle, as viewed from the vehicle side.
Figure 4:
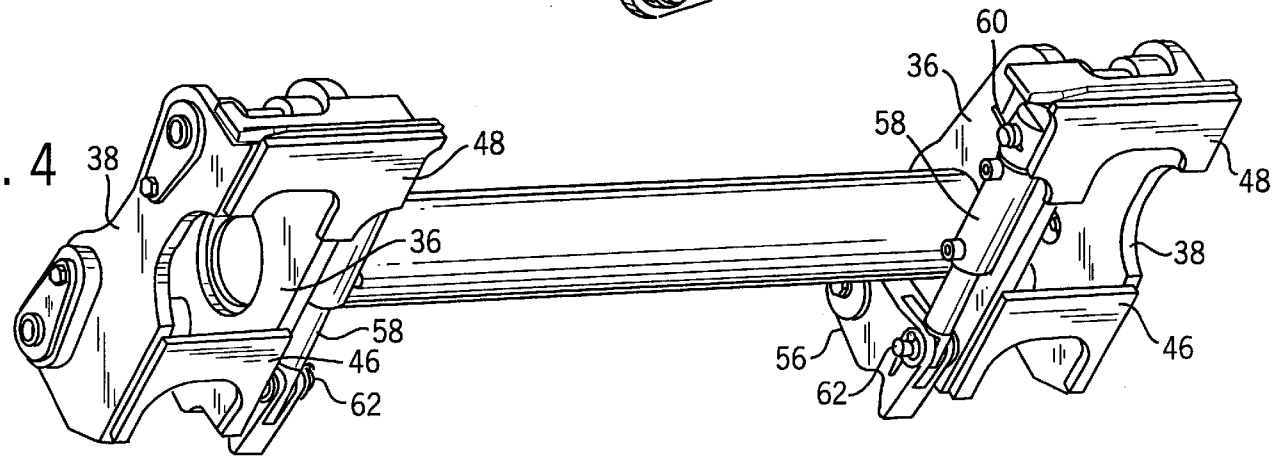
FIG. 4 is a perspective view of the portion of the coupling assembly shown in FIG. 1, which is carried by the implement carrying mechanism of the vehicle, as viewed from the implement side.
Figure 6:
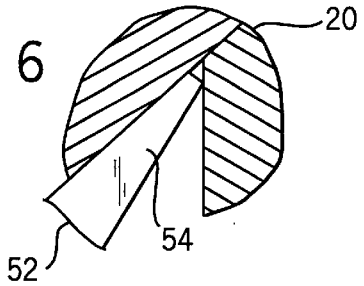
FIG. 6 is an enlarged side view of the engagement of the wedge-shaped probe engaged in the wedge-shaped socket of the coupling assembly shown in FIG. 1.

The plates 36 of the male portion 18 of the coupling assembly are secured to opposite ends of a cylindrical spacer member 44. As best seen in FIG. 4, a pair of metal plates 46 and 48 are secured, near the top and the bottom respectively, to the edges of the spaced plates 36 and 38 facing the rear face 14 of the implement supporting member 16. Referring particularly to FIG. 3, a second pair of metal plates 50 and 52 are secured to the top of the spaced plates 36 and 38, with plate 52 extending at an upward angle over plate 48. As shown in FIG. 6, the upwardly extending end 54 of plate 52 is tapered so as to form a wedge.

Figure 5:
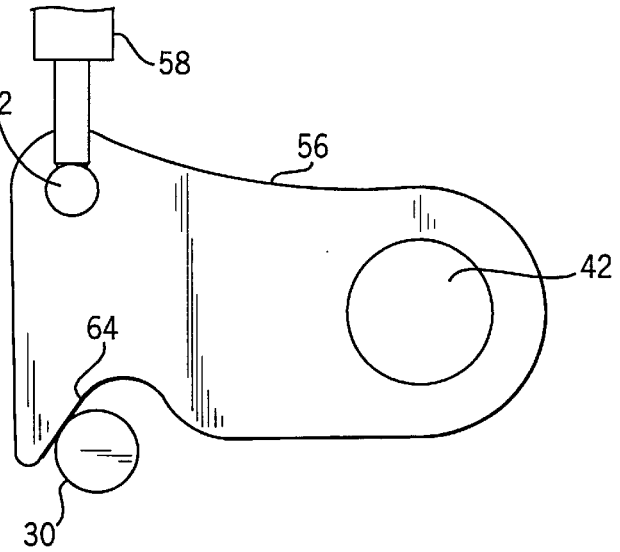
FIG. 5 is an enlarged side view of the hook-like member which is a part of the portion of the coupling assembly shown in FIGS. 3 and 4.

Referring now to FIGS. 4 and 5, hook-like members 56 are pivotally supported on extensions of pins 42 on the facing sides of plates 36. Extensible and retractable members, shown as hydraulic operating cylinders 58, are pivotally supported by pins 60 at their upper end on the plates 36. The lower ends of the hydraulic operating cylinders 58 are pivotally secured to the hook-like members 56 by pins 62.

To secure the female portion 12 of the coupling assembly 10 to the male portion 18, the operator of a vehicle bearing the male portion 18 on its implement carrying portion, adjusts the position of the implement carrying portion such that it approaches the female portion 12 with the tapered upwardly extending ends 54 of plates 52 positioned to enter the wedge shaped sockets 20. The male portion is then pivoted to bring the lower metal plates 46 into engagement with the rear face 14 of the implement supporting member 16 as shown in FIG. 1. The vehicle operator then actuates the hydraulic operating cylinders 58 to pivot the hook-like members 56 into engagement with the cylindrical rods 30, as shown in FIG. 2.

As shown in FIG. 5, the cylindrical rod engaging surfaces or portions 64 of the hook-like members 56 are shaped to apply a force to the cylindrical rods 30 which will pull the male portion 18 toward the rear face 14 of the implement supporting member 16, and also a downward force which will push the tapered upwardly extending ends 54 of plates 52 into tight engagement with the wedge shaped sockets 20 as shown in FIG. 6.

Figure 8:
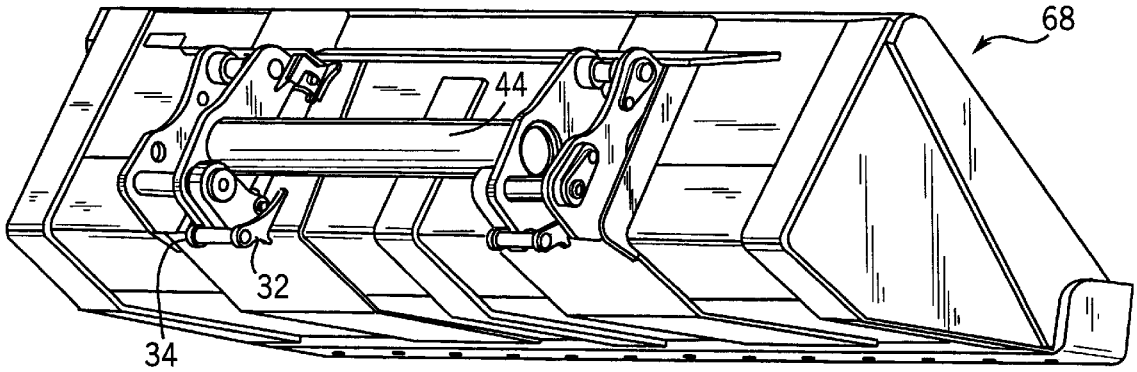
FIG. 8 is a perspective view of the coupling assembly shown in FIG. 1, as installed on a bucket type implement.

FIG. 7 shows the female portion 12 of the coupling assembly of this invention used for mounting a pneumatically operated chisel 66. FIG. 8 shows the female portion 12 engaged with the male portion 18 of the coupling assembly of this invention used for mounting a shovel 68. It should be noted that vertical plates 32 and 34 for supporting the cylindrical rod 30 are of a slightly different shape than those shown in FIGS. 1 and 2.

As described, the coupling assembly of this invention contains fewer parts than are contained in the latching mechanisms of traditional couplers. By reducing both the number of parts and the surface contact of parts which must move with respect to each other in the latch mechanism, and by increasing the mechanical advantage, the chances of binding have been greatly reduced. At the interface, binding has been reduced by the latch mechanism architecture, which provides only edge contact between the engaging surfaces 64 of the hook-like members 56 and the cylindrical rod 30.

The coupling assembly of this invention is designed to hold the attachment tight by the lower hook-like members applying a continuous force to maintain the wedging action between plate 52 and wedge shaped socket 20. The pin or cylindrical rod captured by the tapered engaging surface 64 of the hook-like member 56, in lieu of a tapered pin wedged into a slot as in prior couplers, provides a tighter fit and maintains constant force at the interface allowing the coupler to transfer heavier loads. Since the attachment is tightly fitted to the coupler, wear from heavy loads and vibration is reduced. Preventing excessive wear and maintaining the tight fit assures that the attachment will not uncouple inadvertently. Further, the coupling assembly is self adjusting to tolerance variances and wear from attachment to attachment. Although the embodiment described above includes hydraulic operators to apply a continuous force to the hook-like members, it is contemplated that other mechanical operators be used instead.

The compact design of the latching mechanism of the coupling assembly allows for debris to flow through and not build-up in areas that can "freeze up". If build-up does become a problem, clearing of the latching mechanism is easy since the mechanism has a small number of moving parts.

Figure 9:
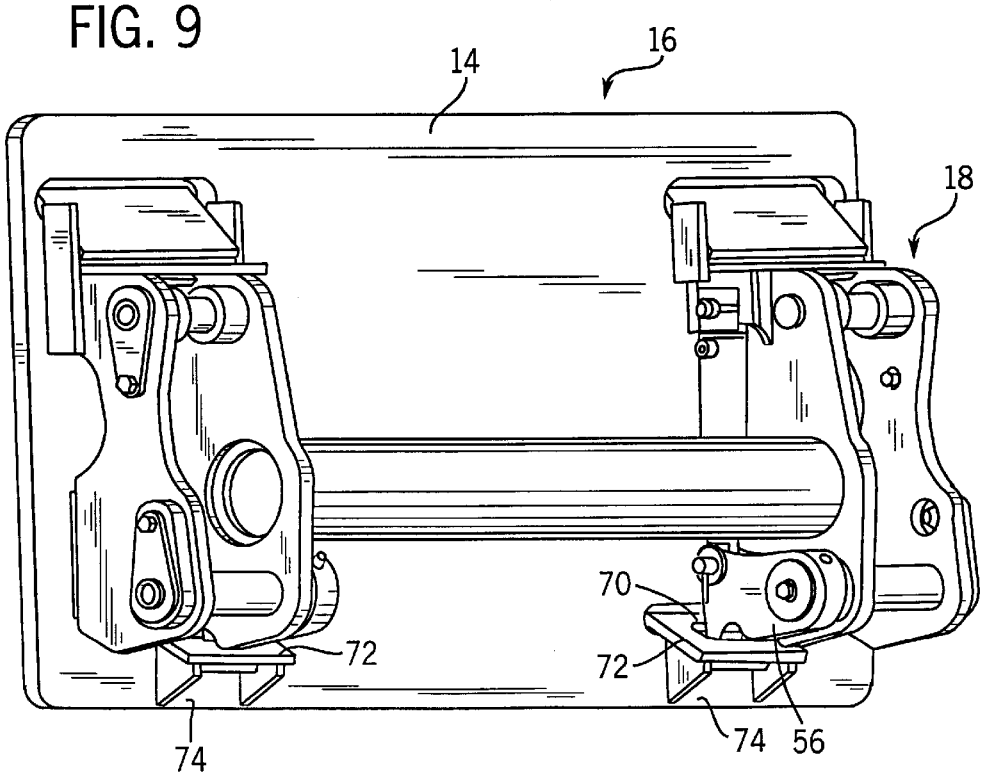
FIG. 9 is a perspective view similar to FIG. 2, showing the portion of the coupling assembly carried by the implement carrying portion of a work vehicle, coupled with the portion of a prior art type coupling assembly carried by the implement.

Referring to FIG. 9, the male portion 18 of the coupling assembly 10 of this invention is shown coupled to a rear face 14 of an implement supporting member 16, which is provided with the female portion of a coupling assembly which has been used in the past. As shown, the hook-like members 56 are engaged in slots 70 which are formed in a shelf-like member 72 of a bracket 74. The male portion of the coupling assembly used in the past included pin like members which were received in the slots.

While the coupling assembly of the present invention is fully compatible with existing attachments that utilize a lower wedge pin securing system, heavy duty attachments which are provided with the female portion of the heavy duty coupling assembly of this invention will not couple with existing couplers provided on loader-arm or a 3-point hitches of work vehicles such as end loaders.

Although various features of the coupling assembly are described and illustrated in the drawings, the present invention is not necessarily limited to these features and may encompass other features disclosed both individually and in various combinations. In accordance with the Patent Statute, changes may be made in the coupling assembly without actually departing from the true spirit and scope of this invention. The appended claims are intended to cover all such changes and modifications which fall within the true spirit and scope of the present invention.

What is claimed is:

1. A coupling assembly for attaching an implement to the implement carrying portion of a work vehicle comprising:

at least one wedge-shaped socket provided on the implement, at least one engageable member provided on the implement, in a spaced relation to the wedge-shaped socket, the socket having a perimeter defining an area, at least one wedge-shaped probe provided on the implement carrying portion of the work vehicle, at least one hook-shaped member pivotally mounted on the implement carrying portion of the work vehicle, an elongated extensible device connected at one end to the implement carrying portion of the work vehicle, and at the other end to the hook-shaped member, whereby an extension force developed by the extensible device causes the hook-shaped member to pivot into engagement with the engageable member to apply a compressive force therebetween, and extending into the area defined by the perimeter of the socket so as to cause the wedge-shaped probe to be pushed into tight engagement in the wedge-shaped socket, thereby securing the implement to the implement carrying portion of the work vehicle to prevent movement therebetween.

2. The coupling assembly of claim 1, wherein the engageable member has a surface at least partially facing the socket.

3. The coupling assembly of claim 2, wherein the engageable surface comprises a rod.

4. The coupling assembly of claim 3, wherein the rod is cylindrical.

5. The coupling assembly of claim 1, for attaching an implement to an implement carrying portion of a work vehicle, wherein the hook-shaped member includes an engageable surface which is formed such that further pivotal movement of the hook-shaped member by extension of the elongated extensible device will cause the engageable surface of the hook-shaped member to be pivoted into engagement with the engageable member so as to maintain a first compressive force between the engageable surface of the hook-shaped member and the engageable member, and a second compressive force between the wedge-shaped probe and the wedge-shaped socket, whereby the implement is rigidly secured to the implement carrying portion of the work vehicle.

6. The coupling assembly of claim 5 wherein the engageable surface of the hook-shaped member is tapered.

7. The coupling assembly of claim 1, for attaching an implement to an implement carrying portion of a work vehicle, wherein said elongated extensible device is hydraulically operated.

8. The coupling assembly of claim 1, for attaching an implement to an implement carrying portion of a work vehicle, wherein the wedge-shaped socket is downwardly opening, and is located above the engageable member, such that the weight of the implement is transferred to the implement carrying portion of the work vehicle through engagement of the wedge-shaped probe in the wedge-shaped socket.

9. The coupling assembly of claim 1, for attaching an implement to an implement carrying portion of a work vehicle, having two wedge-shaped sockets, two wedge-shaped probes, two engageable members, two hook-shaped members, and two elongated extensible devices.

10. The coupling assembly of claim 1, for attaching an implement to an implement carrying portion of a work vehicle, wherein the engageable member is the sidewall of a slot formed in a bracket attached to the implement.

11. A coupling assembly for attaching an implement to an implement carrying portion of a work vehicle comprising:

at least one wedge-shaped socket provided on the implement, the socket having a perimeter defining an area, at least one engageable member provided on the implement in spaced relationship to the socket, at least one wedge-shaped probe provided on the implement carrying portion of the work vehicle, at least one pivotable engagement member supported on the implement carrying portion of the work vehicle in a spaced relationship to the probe, an elongated extensible device connected at one end to the wedge-shaped probe and at the other end to the pivotable engagement member, the extensible device operating such that extension of the elongated extensible device causes the pivotable engagement member to pivot into tight engagement with the engageable member, and causes the wedge-shaped probe to move into the area defined by the perimeter of the socket and into tight engagement in the wedge-shaped socket, whereby the implement is tightly secured to the implement carrying portion of the work vehicle.

12. The coupling assembly of claim 11, wherein the engageable member has a surface at least partially facing the socket.

13. The coupling assembly of claim 12, wherein the engageable surface comprises a rod.

14. The coupling assembly of claim 13, wherein the rod is cylindrical.

15. The coupling assembly of claim 11, wherein the at least one movable engagement member is a hook-shaped member pivotally supported on the implement carrying portion of the work vehicle.

16. The coupling assembly of claim 11, wherein the wedge-shaped socket is downwardly opening, and is located above the engageable member, such that the weight of the implement is transferred to the implement carrying portion of the work vehicle through engagement of the wedge-shaped probe in the wedge-shaped socket.

17. The coupling assembly of claim 11, wherein the moveable engagement member is a hook-shaped member including an engageable tapered surface which is formed such that further pivotal movement of the hook-shaped member by extension of the elongated extensible device will cause the engageable tapered surface of the hook-shaped member to be pivoted into engagement with the engageable member so as to maintain a first compressive force between the engageable surface of the hook-shaped member and the engageable member, and a second compressive force between the wedge-shaped probe and the wedge-shaped socket, whereby the implement is rigidly secured to the implement carrying portion of the work vehicle.

18. The coupling assembly of claim 11, having two wedge-shaped sockets, two wedge-shaped probes, two engageable members, two moveable engagement members, and two elongated extensible devices.

* * * * *